US012564756B2

(12) United States Patent
Lagree et al.

(10) Patent No.: US 12,564,756 B2
(45) Date of Patent: Mar. 3, 2026

(54) TILTING PAD ASSEMBLIES FOR EXERCISE MACHINES

(71) Applicant: Lagree Technologies, Inc., Chatsworth, CA (US)

(72) Inventors: Sebastien Anthony Louis Lagree, Chatsworth, CA (US); Max E. Wunderlich, Los Angeles, CA (US); Hai C. Vo, Ho Chi Minh City (VN)

(73) Assignee: Lagree Technologies, Inc., Chatsworth, CA (US)

( * ) Notice: Subject to any disclaimer, the term of this patent is extended or adjusted under 35 U.S.C. 154(b) by 129 days.

(21) Appl. No.: 18/392,363

(22) Filed: Dec. 21, 2023

(65) Prior Publication Data

US 2025/0205545 A1 Jun. 26, 2025

(51) Int. Cl.
*A63B 21/00* (2006.01)
*A63B 22/00* (2006.01)
*A63B 22/20* (2006.01)

(52) U.S. Cl.
CPC ..... *A63B 21/4027* (2015.10); *A63B 22/0087* (2013.01); *A63B 22/203* (2013.01); *A63B 2225/09* (2013.01)

(58) Field of Classification Search
CPC ..... A63B 21/4027; A63B 21/4029; A63B 22/203; A63B 22/20–208; A63B 22/0076; A63B 22/0087; A63B 2225/09
See application file for complete search history.

(56) References Cited

U.S. PATENT DOCUMENTS

| | | | | |
|---|---|---|---|---|
| 1,621,477 A | | 3/1927 | Pilates | |
| 3,770,267 A | * | 11/1973 | McCarthy | A63B 23/0355 482/130 |
| 3,892,404 A | * | 7/1975 | Martucci | A63B 21/0622 482/145 |
| 4,759,540 A | | 7/1988 | Yu | |
| 4,798,378 A | | 1/1989 | Jones | |
| 5,066,005 A | | 11/1991 | Luecke | |
| 5,263,913 A | | 11/1993 | Boren | |
| D362,700 S | | 9/1995 | Breibart | |
| D382,319 S | | 8/1997 | Gerschefske | |
| 5,681,249 A | | 10/1997 | Endelman | |

(Continued)

FOREIGN PATENT DOCUMENTS

WO 2004096376 A1 11/2004

*Primary Examiner* — Loan B Jimenez
*Assistant Examiner* — Kathleen M Fisk
(74) *Attorney, Agent, or Firm* — Neustel Law Offices

(57) ABSTRACT

A tilting pad assembly for exercise machines and the like. A tilting pad assembly may include a pad and a pivot assembly coupled to the pad. The pivot assembly may include a pair of lift bases having contoured indentations disposed therein, the contoured indentations being opposingly facing and spaced apart. A lift support has a first end pivotably coupled to the pad and a second end having a pair of guide pegs extending outwardly into engagement with the contoured indentations such that the second end of the lift support is moveably captured between the pair of lift bases. The contoured indentations provide a first position for the guide pegs wherein the pad is stably supported by the lift support in a lowered position, and provide a second position for the guide pegs wherein the pad is stably supported by the lift support in a raised position.

9 Claims, 6 Drawing Sheets

(56) References Cited

U.S. PATENT DOCUMENTS 5,885,197 A 3/1999 Barton
5,967,955 A 10/1999 Westfall
6,179,753 B1 1/2001 Barker
7,163,500 B2 1/2007 Endelman
7,465,260 B2 * 12/2008 Hockemeyer ..... A63B 21/4029 482/142
7,803,095 B1 9/2010 Lagree
7,931,570 B2 4/2011 Hoffman
8,033,971 B2 * 10/2011 Campanaro ..... A63B 21/0628 482/142
8,249,714 B1 8/2012 Hartman
8,585,554 B2 11/2013 Shavit
8,641,585 B2 2/2014 Lagree
9,072,931 B2 7/2015 Lagree
9,119,989 B1 9/2015 Lagree
9,138,606 B2 9/2015 Lagree
9,211,440 B2 12/2015 Lagree
9,283,422 B2 3/2016 Lagree
9,370,679 B2 6/2016 Lagree
9,393,454 B2 7/2016 Lagree
D764,606 S 8/2016 Lagree
9,415,253 B2 8/2016 Lagree
9,457,216 B2 10/2016 Lagree
9,457,225 B2 10/2016 Lagree
9,474,924 B2 10/2016 Lagree
9,474,926 B1 10/2016 Lagree
9,474,927 B2 10/2016 Lagree
D772,992 S 11/2016 Lagree
9,498,667 B1 11/2016 Lagree
9,517,375 B2 12/2016 Lagree
9,522,299 B2 12/2016 Lagree
9,533,184 B1 1/2017 Lagree
9,533,185 B1 1/2017 Lagree
9,545,535 B2 1/2017 Lagree
9,555,282 B1 1/2017 Lagree
9,579,536 B1 2/2017 Lagree
9,579,555 B2 2/2017 Lagree
9,586,081 B2 3/2017 Lagree
9,586,089 B2 3/2017 Lagree
9,597,545 B1 3/2017 Lagree
9,604,095 B1 3/2017 Lagree
9,604,097 B1 3/2017 Lagree
D785,104 S 4/2017 Lagree
9,643,051 B1 5/2017 Lagree
9,649,526 B2 5/2017 Lagree
9,649,527 B1 5/2017 Lagree
D789,463 S 6/2017 Lagree
9,700,754 B2 7/2017 Lagree
9,717,945 B2 8/2017 Lagree
9,744,395 B1 8/2017 Lagree
9,776,043 B2 10/2017 Lagree
9,776,062 B2 10/2017 Lagree
9,789,354 B2 10/2017 Lagree
9,808,664 B2 11/2017 Lagree
9,849,330 B2 12/2017 Lagree
9,868,009 B2 1/2018 Lagree
9,868,010 B2 1/2018 Lagree
9,868,011 B2 1/2018 Lagree
9,868,018 B2 1/2018 Lagree
9,868,019 B2 1/2018 Lagree
9,914,014 B2 3/2018 Lagree
9,962,573 B2 5/2018 Lagree
9,962,592 B2 5/2018 Lagree
9,981,156 B2 5/2018 Lagree
10,016,655 B2 7/2018 Lagree
10,022,577 B2 7/2018 Lagree
10,022,581 B2 7/2018 Lagree
10,029,141 B2 7/2018 Lagree
10,046,193 B1 8/2018 Aronson
10,052,518 B2 8/2018 Lagree
10,065,069 B1 9/2018 Lagree
10,109,216 B2 10/2018 Lagree
10,118,067 B2 11/2018 Lagree
10,124,232 B2 11/2018 Lagree
10,143,882 B2 12/2018 Lagree
10,150,003 B2 12/2018 Lagree
10,155,129 B2 12/2018 Lagree
10,201,724 B2 2/2019 Lagree
10,213,641 B2 2/2019 Lagree
10,220,244 B2 3/2019 Lagree
10,238,910 B2 3/2019 Lagree
10,265,573 B2 4/2019 Lagree
10,272,285 B2 4/2019 Lagree
10,279,207 B2 5/2019 Lagree
10,300,328 B2 5/2019 Lagree
10,369,398 B2 8/2019 Lagree
10,478,656 B2 11/2019 Lagree
10,478,663 B2 11/2019 Lagree
10,486,017 B1 11/2019 Lagree
10,493,321 B2 12/2019 Lagree
10,500,441 B2 12/2019 Lagree
10,518,127 B2 12/2019 Lagree
10,549,140 B2 2/2020 Lagree
10,561,896 B2 2/2020 Lagree
10,569,118 B2 2/2020 Lagree
10,603,546 B1 3/2020 Lagree
10,695,645 B1 6/2020 Lagree
10,702,730 B2 7/2020 Lagree
10,702,760 B2 7/2020 Lagree
10,716,964 B1 7/2020 Lagree
10,744,370 B1 8/2020 Lagree
10,751,600 B2 8/2020 Lagree
10,780,307 B2 9/2020 Lagree
10,792,528 B1 10/2020 Lagree
10,792,538 B2 10/2020 Lagree
10,814,158 B2 * 10/2020 Mancias ..... A63B 21/078
10,835,775 B1 11/2020 Lagree
10,850,154 B2 * 12/2020 Baker ..... A63B 21/4029
10,850,155 B2 12/2020 Lagree
10,850,158 B2 12/2020 Lagree
10,857,418 B2 12/2020 Lagree
10,857,420 B2 12/2020 Lagree
10,864,399 B2 12/2020 Lagree
10,870,034 B2 12/2020 Lagree
10,881,896 B2 1/2021 Lagree
10,912,982 B2 2/2021 Lagree
10,926,127 B1 2/2021 Lagree
10,940,358 B2 3/2021 Lagree
10,940,359 B2 3/2021 Lagree
10,946,230 B2 3/2021 Lagree
10,957,218 B1 3/2021 Lagree
10,974,089 B1 4/2021 Lagree
10,974,092 B2 4/2021 Lagree
10,994,168 B2 5/2021 Lagree
11,000,727 B2 5/2021 Lagree
11,020,627 B1 6/2021 Lagree
11,040,234 B2 6/2021 Lagree
11,465,011 B1 * 10/2022 Lagree ..... A63B 22/0089
11,794,065 B2 * 10/2023 Lagree ..... A63B 21/023
2001/0056011 A1 12/2001 Endelman
2003/0119635 A1 6/2003 Arbuckle
2005/0130810 A1 6/2005 Sands
2005/0164856 A1 7/2005 Parmater
2006/0046914 A1 3/2006 Endelman
2006/0199712 A1 9/2006 Barnard
2007/0087921 A1 4/2007 Graham
2008/0070765 A1 3/2008 Brown
2008/0248935 A1 10/2008 Solow
2010/0227748 A1 9/2010 Campanaro
2011/0009249 A1 1/2011 Campanaro
2011/0143898 A1 6/2011 Trees
2011/0166002 A1 7/2011 Savsek
2011/0172069 A1 7/2011 Gerschefske
2012/0295771 A1 11/2012 Lagree
2013/0017935 A1 1/2013 Endelman
2013/0196835 A1 8/2013 Solow
2014/0011645 A1 1/2014 Johnson
2014/0100089 A1 4/2014 Kermath
2014/0121076 A1 5/2014 Lagree
2014/0121078 A1 5/2014 Lagree
2014/0121079 A1 5/2014 Lagree
2014/0141948 A1 5/2014 Aronson
2015/0024914 A1 1/2015 Lagree
2015/0057127 A1 2/2015 Lagree

(56) References Cited

U.S. PATENT DOCUMENTS

| | | | |
|---|---|---|---|
| 2015/0065318 | A1 | 3/2015 | Lagree |
| 2015/0072841 | A1 | 3/2015 | Lagree |
| 2015/0141204 | A1 | 5/2015 | Lagree |
| 2015/0217164 | A1 | 8/2015 | Lagree |
| 2015/0220523 | A1 | 8/2015 | Lagree |
| 2015/0246263 | A1 | 9/2015 | Campanaro |
| 2015/0297944 | A1 | 10/2015 | Lagree |
| 2015/0343250 | A1 | 12/2015 | Lagree |
| 2015/0360068 | A1 | 12/2015 | Lagree |
| 2015/0360083 | A1 | 12/2015 | Lagree |
| 2015/0360113 | A1 | 12/2015 | Lagree |
| 2015/0364058 | A1 | 12/2015 | Lagree |
| 2015/0367166 | A1 | 12/2015 | Lagree |
| 2016/0008657 | A1 | 1/2016 | Lagree |
| 2016/0059060 | A1 | 3/2016 | Lagree |
| 2016/0059061 | A1 | 3/2016 | Lagree |
| 2016/0096059 | A1 | 4/2016 | Lagree |
| 2016/0166870 | A1 | 6/2016 | Lagree |
| 2016/0193496 | A1 | 7/2016 | Lagree |
| 2016/0256733 | A1 | 9/2016 | Lagree |
| 2016/0271452 | A1 | 9/2016 | Lagree |
| 2016/0317858 | A1 | 11/2016 | Lagree |
| 2016/0346593 | A1 | 12/2016 | Lagree |
| 2016/0361602 | A1 | 12/2016 | Lagree |
| 2017/0014664 | A1 | 1/2017 | Lagree |
| 2017/0014672 | A1 | 1/2017 | Lagree |
| 2017/0036057 | A1 | 2/2017 | Lagree |
| 2017/0036061 | A1 | 2/2017 | Lagree |
| 2017/0043210 | A9 | 2/2017 | Lagree |
| 2017/0065846 | A1 | 3/2017 | Lagree |
| 2017/0072252 | A1 | 3/2017 | Lagree |
| 2017/0087397 | A1 | 3/2017 | Lagree |
| 2017/0100625 | A1 | 4/2017 | Lagree |
| 2017/0100629 | A1 | 4/2017 | Lagree |
| 2017/0106232 | A1 | 4/2017 | Lagree |
| 2017/0113091 | A1 | 4/2017 | Lagree |
| 2017/0120101 | A1 | 5/2017 | Lagree |
| 2017/0144013 | A1 | 5/2017 | Lagree |
| 2017/0157452 | A1 | 6/2017 | Lagree |
| 2017/0157458 | A1 | 6/2017 | Lagree |
| 2017/0165518 | A1 | 6/2017 | Lagree |
| 2017/0165555 | A1 | 6/2017 | Lagree |
| 2017/0189740 | A1 | 7/2017 | Lagree |
| 2017/0189741 | A1 | 7/2017 | Lagree |
| 2017/0209728 | A1 | 7/2017 | Lagree |
| 2017/0239526 | A1 | 8/2017 | Lagree |
| 2017/0246491 | A1 | 8/2017 | Lagree |
| 2017/0246499 | A1 | 8/2017 | Lagree |
| 2017/0296865 | A1 | 10/2017 | Lagree |
| 2017/0304673 | A1 | 10/2017 | Lagree |
| 2017/0326406 | A1 | 11/2017 | Lagree |
| 2017/0340947 | A1 | 11/2017 | Lagree |
| 2017/0354840 | A1 | 12/2017 | Lagree |
| 2018/0015319 | A1 | 1/2018 | Lagree |
| 2018/0021621 | A1 | 1/2018 | Lagree |
| 2018/0021655 | A1 | 1/2018 | Lagree |
| 2018/0036583 | A1 | 2/2018 | Lagree |
| 2018/0056109 | A1 | 3/2018 | Lagree |
| 2018/0056133 | A1 | 3/2018 | Lagree |
| 2018/0111020 | A1 | 4/2018 | Lagree |
| 2018/0111033 | A1 | 4/2018 | Lagree |
| 2018/0117392 | A1 | 5/2018 | Lagree |
| 2018/0133532 | A1 | 5/2018 | Lagree |
| 2018/0133533 | A1 | 5/2018 | Lagree |
| 2018/0133534 | A1 | 5/2018 | Lagree |
| 2018/0133542 | A1 | 5/2018 | Lagree |
| 2018/0178053 | A1 | 6/2018 | Lagree |
| 2018/0193691 | A1 | 7/2018 | Lagree |
| 2018/0207469 | A1 | 7/2018 | Aronson |
| 2018/0250551 | A1 | 9/2018 | Lagree |
| 2018/0250573 | A1 | 9/2018 | Lagree |
| 2018/0272179 | A1 | 9/2018 | Lagree |
| 2018/0280782 | A1 | 10/2018 | Lagree |
| 2018/0318627 | A1 | 11/2018 | Lagree |
| 2018/0318646 | A1 | 11/2018 | Lagree |
| 2018/0326252 | A1 | 11/2018 | Lagree |
| 2018/0353803 | A1 | 12/2018 | Lagree |
| 2018/0361190 | A1 | 12/2018 | Lagree |
| 2018/0361197 | A1 | 12/2018 | Lagree |
| 2019/0083842 | A1 | 3/2019 | Lagree |
| 2019/0160320 | A1 | 5/2019 | Lagree |
| 2019/0160329 | A1 | 5/2019 | Lagree |
| 2019/0232105 | A1 | 8/2019 | Lagree |
| 2019/0240530 | A1 | 8/2019 | Lagree |
| 2019/0247694 | A1 | 8/2019 | Lagree |
| 2019/0247705 | A1 | 8/2019 | Lagree |
| 2019/0247707 | A1 | 8/2019 | Lagree |
| 2019/0255375 | A1 | 8/2019 | Lagree |
| 2019/0269961 | A1 | 9/2019 | Lagree |
| 2019/0314672 | A1 | 10/2019 | Lagree |
| 2019/0358484 | A1 | 11/2019 | Lagree |
| 2020/0030657 | A1 | 1/2020 | Lagree |
| 2020/0047051 | A1 | 2/2020 | Lagree |
| 2020/0054913 | A1 | 2/2020 | Lagree |
| 2020/0078630 | A1 | 3/2020 | Lagree |
| 2020/0078634 | A1 | 3/2020 | Lagree |
| 2020/0171337 | A1 | 6/2020 | Lagree |
| 2020/0188720 | A1 | 6/2020 | Villency |
| 2020/0222741 | A1 | 7/2020 | Aronson |
| 2020/0353306 | A1 | 11/2020 | Lagree |
| 2020/0376326 | A1 | 12/2020 | Lagree |
| 2020/0376359 | A1 | 12/2020 | Lagree |
| 2021/0069542 | A1 | 3/2021 | Lagree |
| 2021/0069572 | A1 | 3/2021 | Lagree |
| 2021/0086023 | A1 | 3/2021 | Lagree |
| 2021/0101048 | A1 | 4/2021 | Lagree |
| 2021/0121734 | A1 | 4/2021 | Lagree |
| 2021/0154555 | A1 | 5/2021 | Lagree |
| 2021/0187343 | A1 | 6/2021 | Lagree |
| 2021/0187345 | A1 | 6/2021 | Lagree |
| 2021/0244993 | A1 | 8/2021 | Singer |
| 2022/0176190 | A1* | 6/2022 | Pena ..... A63B 22/0235 |
| 2024/0066350 | A1* | 2/2024 | Hibberts ..... A63B 21/4031 |
| 2024/0108940 | A1* | 4/2024 | Hagans ..... A63B 21/4029 |

* cited by examiner

TILTING PAD ASSEMBLIES FOR EXERCISE MACHINES

CROSS REFERENCE TO RELATED APPLICATIONS

Not applicable to this application.

STATEMENT REGARDING FEDERALLY SPONSORED RESEARCH OR DEVELOPMENT

Not applicable to this application.

FIELD OF THE INVENTION

The described example embodiments in general relate to tilting pad assemblies, and more specifically, to pad assemblies that may be easily pivoted by a user, such as for use with exercise machines and the like.

BACKGROUND

Exercise machines are highly useful devices that enable people to maintain or improve their physical health and appearance. Existing exercise machines may enable a person to perform a variety of resistance training exercises in a safe and convenient manner in the person's home, office, or other desired environment.

In some cases, prior art exercise machines have advantageously enabled users to perform exercises by sitting, kneeling, or otherwise engaging the user's body with a pad of the exercise machine, such as a fixed, level pad. Although highly successful results have been achieved using such prior art exercise machines, there is room for improvement.

SUMMARY

Some of the various embodiments of the present disclosure relate to tilting pad 2 assemblies, and more specifically, to pad assemblies that may be easily pivoted by a user, such as for use with exercise machines and the like. More specifically, in some embodiments, a tilting pad assembly in accordance with the present disclosure may enable a pad to be easily movable between a lowered (or level) position and a raised (or tilted) position. Embodiments in accordance with the present disclosure may advantageously enable a user to adjust a position of a pad of an exercise machine whenever they desire to do so in a quick and convenient manner.

More specifically, in some embodiments, a tilting pad assembly for an exercise machine comprises: a pad, and a pivot assembly pivotably coupling the pad to a pad support. In some embodiments, the pivot assembly includes: a pair of lift bases, each lift base having a contoured indentation disposed therein, the pair of lift bases being coupled to the pad support such that the contoured indentations are opposingly facing and spaced apart; and a lift support having a first end pivotably coupled to the pad and a second end having a pair of guide pegs extending outwardly from the second end in opposing directions and into engagement with the contoured indentations such that the second end of the lift support is moveably captured between the pair of lift bases with the guide pegs moveably disposed within the contoured indentations, wherein the contoured indentations provide a first position for the guide pegs wherein the pad is stably supported by the lift support in a lowered position, and provide a second position for the guide pegs wherein the pad is stably supported by the lift support in a raised position.

Similarly, in some embodiments, an exercise machine comprises: a support frame; a tilting pad assembly operatively coupled to the support frame, the tilting pad assembly including at least: a pad; and at least one pivot assembly pivotably coupling the pad to a pad support, the at least one pivot assembly including: a pair of lift bases, each lift base having a contoured indentation disposed therein, the pair of lift bases being coupled to the pad support such that the contoured indentations are opposingly facing and spaced apart; and a lift support having a first end pivotably coupled to the pad and a second end having a pair of guide pegs extending outwardly from the second end in opposing directions and into engagement with a corresponding one of the contoured indentations such that the second end of the lift support is moveably captured between the pair of lift bases with the pair of guide pegs moveably disposed within the opposingly-facing contoured indentations, wherein the contoured indentations provides a first position for the guide pegs wherein the pad is stably supported by the lift support in a lowered position, and further provides a second position for the guide pegs wherein the pad is stably supported by the lift support in a raised position.

There has thus been outlined, rather broadly, some of the embodiments of the present disclosure in order that the detailed description thereof may be better understood, and in order that the present contribution to the art may be better appreciated. There are additional embodiments that will be described hereinafter and that will form the subject matter of the claims appended hereto. In this respect, before explaining at least one embodiment in detail, it is to be understood that the various embodiments are not limited in its application to the details of construction or to the arrangements of the components set forth in the following description or illustrated in the drawings. Also, it is to be understood that the phraseology and terminology employed herein are for the purpose of the description and should not be regarded as limiting.

To better understand the nature and advantages of the present disclosure, reference should be made to the following description and the accompanying figures. It is to be understood, however, that each of the figures is provided for the purpose of illustration only and is not intended as a definition of the limits of the scope of the present disclosure. Also, as a general rule, and unless it is evidence to the contrary from the description, where elements in different figures use identical reference numbers, the elements are generally either identical or at least similar in function or purpose.

DETAILED DESCRIPTION

A. Overview

Some of the various embodiments of the present disclosure relate to tilting pad assemblies for use in exercise machines, and more specifically, to tilting pad assemblies that enable a pad to be easily movable between a lowered (or level) position and a raised (or tilted) position. Embodiments in accordance with the present disclosure May advantageously enable a user to adjust a position of a pad of an exercise machine whenever they desire to do so in a quick and convenient manner.

In some embodiments, a tilting pad assembly comprises a pad configured to be pivotably coupled to a pad support, and a pair of lift bases. In some embodiments, each lift base has a contoured indentation disposed therein, and the pair of lift bases are configured to be coupled to the pad support such that the contoured indentations are opposingly facing and spaced apart. The tilting pad assembly may further include a lift support having a first end pivotably coupled to the pad and a second end having a pair of guide pegs extending outwardly from the second end in opposing directions and into engagement with a corresponding one of the contoured indentations such that the second end of the lift support is moveably captured between the pair of lift bases with the pair of guide pegs disposed within the opposingly-facing contoured indentations. In some embodiments, the contoured indentations are configured to provide a lower position for the guide pegs wherein the pad is stably supported by the lift support in a level position, and an upper position for the guide pegs wherein the pad is stably supported by the lift support in a tilted position.

Various embodiments of tilting pad assemblies, and exercise machines that include such tilting pad assemblies, are described herein. Many specific details of certain embodiments are set forth in the following description and in FIGS. 1-10 to provide a thorough understanding of such embodiments. One skilled in the art will understand, however, that the invention may have additional embodiments, or that alternate embodiments may be practiced without several of the details described in the following description.

B. Exercise Machine

Figure 1:
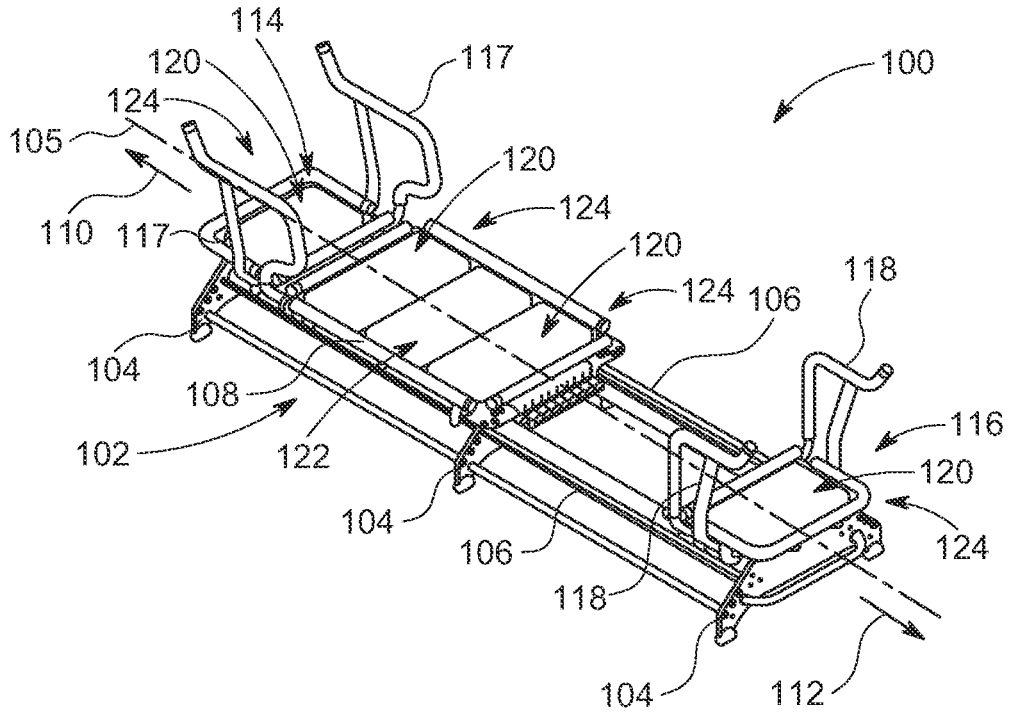
FIG. 1 is a perspective view of an exercise machine having a tilting pad assembly in a lowered position in accordance with an example embodiment.

Tilting pad assemblies in accordance with the present disclosure may be incorporated into a wide variety of exercise machines and may be used in a wide variety of use scenarios. For example, FIG. 1 is a perspective view of an exercise machine 100 in accordance with an example embodiment. In this embodiment, the exercise machine 100 includes a support frame 102 having a plurality of frame members 104 that support a pair of rails 106. In some embodiments, the rails 106 may be parallel and may extend lengthwise along a longitudinal axis 105 of the exercise machine 100. A slidable carriage 108 may slide along the rails 106 in response to a user's movements. For example, a user may perform exercises by moving the slidable carriage 108 along the rails 106 in forward and rearward directions 110, 112 substantially along the longitudinal axis 105 of the exercise machine 100. In some embodiments, the exercise machine 100 further includes a forward platform 114 disposed on the support frame 102, and a rearward platform 116 disposed on the support frame 102. As shown in FIG. 1, the slidable carriage 108 may be disposed on the rails 106 and May be moveable between the forward platform 114 and the rear platform 116. In some embodiments, the exercise machine 100 may also include one or more forward handles 117 that extend upwardly from the support frame 102 proximate the forward platform 114, and one or more rear handles 118 that extend upwardly from the support frame 102 proximate the rear platform 116.

As further shown in FIG. 1, in some embodiments, the exercise machine 100 includes one or more tilting pad assemblies 120. More specifically, in the embodiment shown in FIG. 1, the forward platform 114 of the exercise machine 100 includes a tilting pad assembly 120, the rear platform 116 of the exercise machine 100 includes a tilting pad assembly 120, and the slidable carriage 108 of the exercise machine 100 includes two tilting pad assemblies 120. In some embodiments, the exercise machine 100 may also include one or more fixed (or non-tilting) pad assemblies 122. For example, in the embodiment shown in FIG. 1, the slidable carriage 108 of the exercise machine 100 includes a fixed pad assembly 122. In FIG. 1, the exercise machine 100 is shown with the tilting pad assemblies 120 positioned in a lowered position 124, while in FIG. 2, the exercise machine 100 is shown with the tilting pad assemblies 120 positioned in a raised position 126.

C. Tilting Pad Assembly

Figure 2:
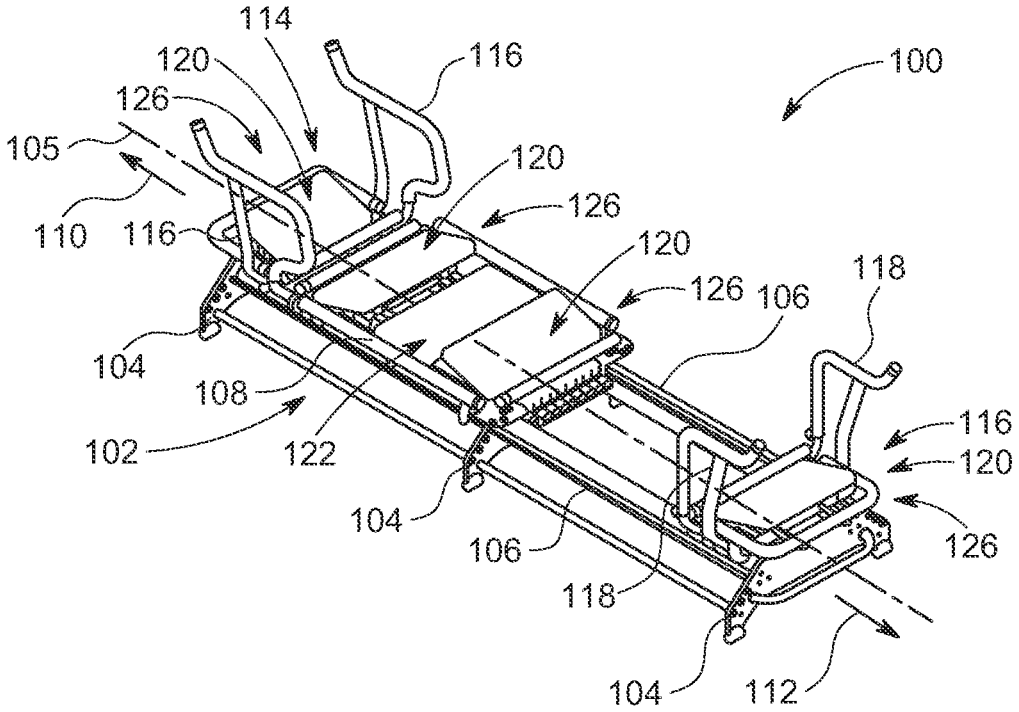
FIG. 2 is a perspective view of the exercise machine of FIG. 1 with the tilting pad assembly in a raised position in accordance with an example embodiment.
Figure 3:
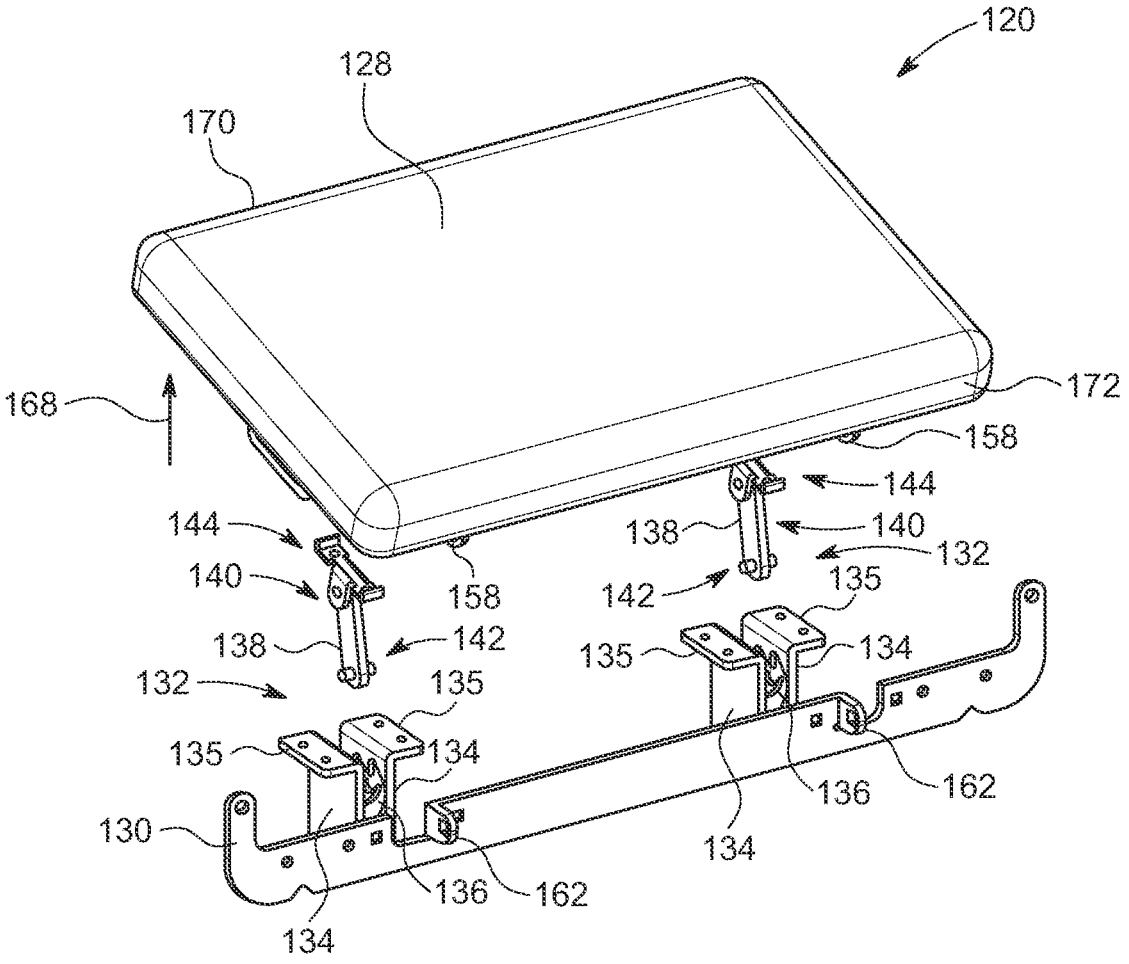
FIG. 3 is a partially-exploded perspective view of a tilting pad assembly of the exercise machine of FIGS. 1 and 2 in accordance with an example embodiment.

FIG. 3 is a partially-exploded perspective view of the tilting pad assembly 120 of the exercise machine 100 of FIGS. 1 and 2 in accordance with an example embodiment. In some embodiments, the tilting pad assembly 120 includes a pad 128 pivotably coupled to a pad support 130 by a pair of pivot assemblies 132. The pad support 130 may, for example, be coupled to (or a portion of) the support frame 102 of the exercise machine 100 shown in FIG. 1. In some embodiments, each pivot assembly 132 includes a pair of lift bases 134 operatively coupled to the pad support 130. In some embodiments, each lift base 134 has a contoured indentation 136 disposed therein, and the pair of lift bases 134 are coupled to the pad support 130 such that the contoured indentations 136 of the pair of lift bases 134 are opposingly facing and spaced apart by an operatively appropriate distance, as described more fully below.

Figure 4:
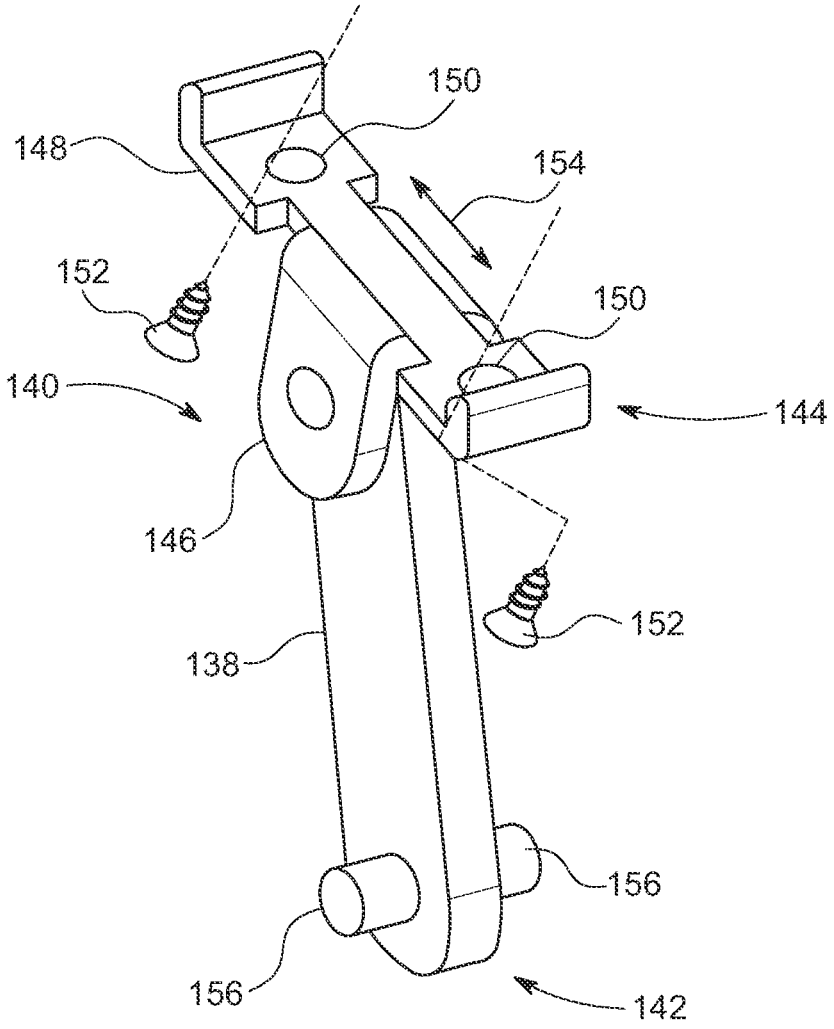
FIG. 4 is a perspective view of a lift support of a pivot assembly of FIG. 3 in accordance with an example embodiment.

In addition, each of the pivot assemblies 132 further includes a lift support 138. In some embodiments, the lift support 138 has a first end 140 pivotably coupled to the pad 128 and a second end 142 movably engaged with the pair of lift bases 134. More specifically, FIG. 4 shows an enlarged perspective view of the lift support 138 of FIG. 3 in accordance with an example embodiment. In some embodiments, a coupling assembly 144 operatively couples the first end 140 of the lift support 138 to the pad 128, wherein the coupling assembly 144 includes a bale member 146 that is pivotably coupled to the first end 140 of the lift support 138, and a tab member 148 that is coupled to the pad 128. For example, as shown in FIG. 4, in some embodiments, the tab member 148 has one or more coupling apertures 150 (e.g. two) through which one or more fasteners 152 (e.g. screws, etc.) are engaged through into coupling engagement with a lower pad surface 160 (FIGS. 5-6) of the pad 128. In addition, in some embodiments, the bale member 146 is moveably attached to the tab member 148, such that the bale member 146 is moveable lengthwise along the tab member 148 as indicated by movement arrow 154.

As further shown in FIG. 4, the second end 142 of the lift support 138 includes a pair of guide pegs 156 extending outwardly therefrom. More specifically, in some embodiments, the pair of guide pegs 156 extend outwardly from the second end 142 in opposing directions and into engagement with a corresponding one of the contoured indentations 136 of the lift bases 134 such that the second end 142 of the lift support 138 is moveably captured between the pair of lift bases 134 with the pair of guide pegs 156 disposed within the opposingly-facing contoured indentations 136 of the lift bases 134. It will be appreciated that the contoured indentations 136 are opposingly facing and spaced apart by an operatively appropriate distance that enables the lift support 138 to move between the lift bases 134 as the tilting pad assembly 120 is actuated by a user between the lowered position 124 and the raised position 126, as described more fully below.

Referring again to FIG. 3, in some embodiments, each lift base 134 of the pivot assembly 132 may include a support portion 135 that may engage with the lower pad surface 160 when the pad 128 is in the lowered position 124. In this way, the support portions 135 of the lift bases 134 may engage with the pad 128 (e.g. the lower pad surface 160) when the tilting pad assembly 120 is in the lowered position 124 such as, for example, when the user is engaged with the pad 128 during use of the exercise machine 100.

Figure 5:
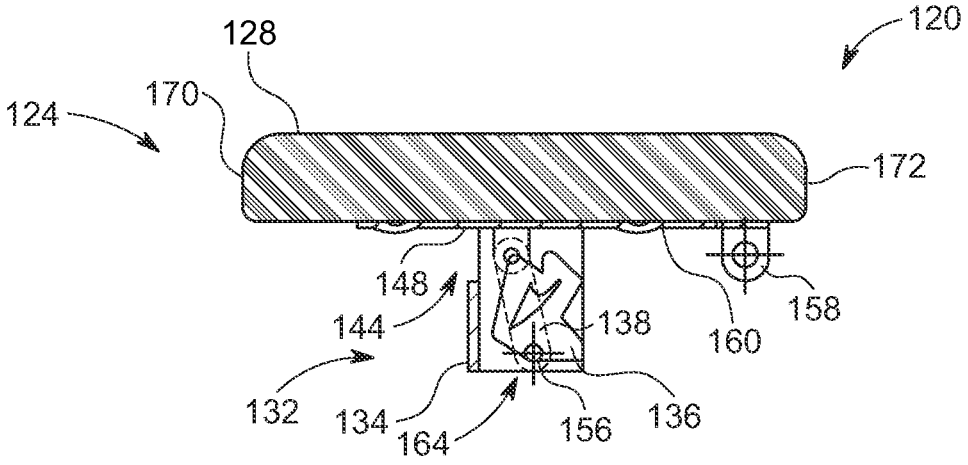
FIG. 5 is a side partially-transparent view of the tilting pad assembly of FIG. 3 in a lowered position in accordance with an example embodiment.
Figure 6:
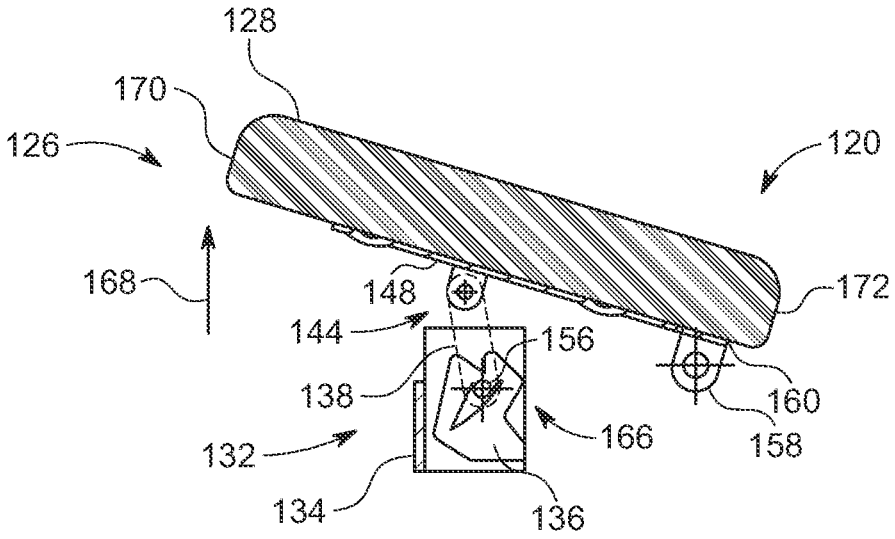
FIG. 6 is a side partially-transparent view of the tilting pad assembly of FIG. 3 in a raised position in accordance with an example embodiment.

As best shown in FIGS. 3 and 5-6, in some embodiments, the pad 128 includes a pair of pivot eyes 158 that extend downwardly from the lower pad surface 160 of the pad 128. In some embodiments, each pivot eye 158 may be pivotably coupled to a pivot base 162 of the pad support 130. In some embodiments, the pivot eyes 158 may extend downwardly from the lower pad surface 160 of the pad 128 proximate to a trailing edge 172 of the pad 128 as depicted in FIGS. 5 and 6.

It will be appreciated that the guide pegs 156 are moveable within the contoured indentations 136 of the lift bases 134 to enable pivoting of the pad 128 of the tilting pad assembly 120. More specifically, in some embodiments, the contoured indentations 136 are configured to provide a first position 164 for the pair of guide pegs 156 wherein the pad 128 is stably supported by the lift support 138 in the lowered position 124, and a second position 166 for the pair of guide pegs 156 wherein the pad 128 is stably supported by the lift support 138 in the raised position 126, as described more fully below. As the guide pegs 156 are moved between the first and second positions 164, 166, the pad 128 of the tilting pad assembly 120 pivots about the pivot bases 162.

FIGS. 5 and 6 are side views of the tilting pad assembly 120 of FIG. 3 in the lowered position 124, and in the raised position 126, respectively. In FIGS. 5 and 6, the pivot assembly 132 of the tilting pad assembly 120 is depicted in a partially transparent manner so that the various components of the pivot assembly 132, including the contoured indentation 136, the lift support 138, and one of the guide pegs 156, are visible to the viewer to facilitate an understanding of the pivot assembly 132.

As best shown in FIG. 5, when the guide pegs 156 are positioned in the contoured indentation 136 at the first position 164, the tilting pad assembly 120 is in the lowered position 124 with the pad 128 in a generally lowered (or level) position. In the lowered position 124, the lift support 138 (shown in dotted lines) is generally disposed between the lift bases 134 of the pivot assembly 132, with the tab member 148 of the coupling assembly 144 in a relatively level (or horizontal) position.

As shown in FIG. 6, when a user applies a lifting force 168 on the pad 128 (e.g. by grasping a leading edge 170 of the pad 128 and lifting upwardly), the guide pegs 156 are moved upwardly within the contoured indentations 136 of the lift bases 134 to reposition the guide pegs 156 from the first position 164 (FIG. 5) to the second position 166 (FIG. 6), and the pad 128 pivots on the pivot bases 162 into the raised position 126. With the guide pegs 156 positioned in the contoured indentation 136 at the second position 166, the tilting pad assembly 120 is held stably in the raised position 126 with the pad 128 in a generally tilted (or non-level) position.

Accordingly, in some embodiments, a pivot assembly 132 configured to pivotably couple a pad 128 to a pad support 130 comprises: a pair of lift bases 134, each lift base 134 having a contoured indentation 136 disposed therein, the pair of lift bases 134 being configured to be coupled to the pad support 130 such that the contoured indentations 136 are opposingly facing and spaced apart; and a lift support 138 having a first end 140 configured to be pivotably coupled to the pad 128 and a second end 142 having a pair of guide pegs 156 extending outwardly from the second end 142 in opposing directions and into engagement with a corresponding one of the contoured indentations 136 such that the second end 142 of the lift support 138 is moveably captured between the pair of lift bases 134 with the pair of guide pegs 156 moveably disposed within the opposingly-facing contoured indentations 136, wherein the contoured indentations 136 are configured to provide a first position 164 for the guide pegs 156 wherein the pad 128 is stably supported by the lift support 138 in a lowered position 124, and further configured to provide a second position 166 for the guide pegs 156 wherein the pad 128 is stably supported by the lift support 138 in a raised position 126.

In some embodiments, each lift base 134 includes a support portion 135 that is configured to engage with a lower pad surface 160 when the guide pegs 156 are positioned in the first position 164. And in some embodiments, the pad 128 is pivotably coupled to the pad support 130 at a pivot base 162 such that the pad 128 is pivotable about the pivot base 162 as the guide pegs 156 are moved within the contoured indentations 136 between the first position 164 and the second position 166.

In addition, in some embodiments, the first end 140 of the lift support 138 is pivotably coupled to the pad 128 by a coupling assembly 144, the coupling assembly 144 including a tab member 148 coupled to a lower pad surface 160, and a bale member 146 coupled to the tab member 148 and pivotably coupled to the first end 140 of the lift support 138. In some embodiments, the bale member 146 is slideably moveable along a lengthwise portion of the tab member 148.

In still other embodiments, each lift base 134 includes a flat surface (e.g. guide surface 174), the contoured indentation 136 being disposed in the flat surface (e.g. guide surface 174). Similarly, in some embodiments, the contoured indentations 136 are opposingly facing and spaced apart by an operational distance that enables the second end 142 of the lift support 138 to move between the flat surfaces (e.g. guide surfaces 174) as the pair of guide pegs 156 are moved between the first position 164 and the second position 166.

D. Contoured Indentations

Figure 7:
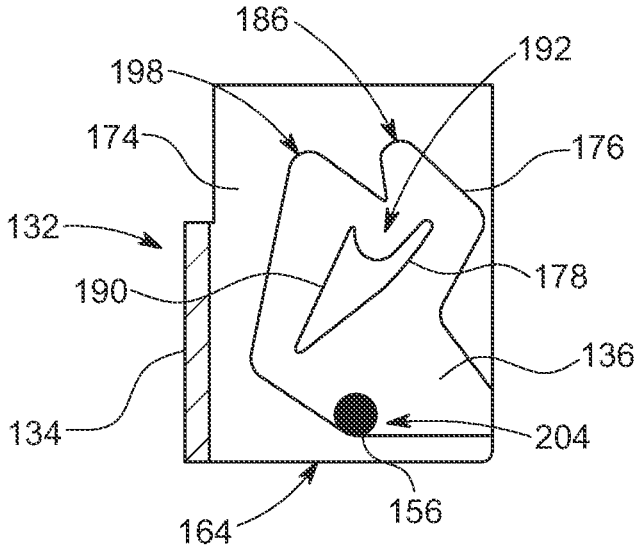
FIG. 7 is a side elevational view of a contoured indentation of the tilting pad assembly of FIG. 3 with a guide peg in a first position in accordance with an example embodiment.

As noted above, in some embodiments, the contoured indentations 136 are configured to provide a first position 164 for the guide pegs 156 wherein the pad 128 is stably supported by the lift support 138 in a lowered (or level) position 124, and further configured to provide a second position 166 for the guide pegs 156 wherein the pad 128 is stably supported by the lift support 138 in a raised (or tilted) position 126. It will be appreciated that the contoured indentations 136 of the pivot assembly 132 may have a wide 24 variety of suitable shapes and orientations consistent with the present disclosure. For example, FIG. 7 is a side elevational view of a contoured indentation 136 of the pivot assembly 132 of FIG. 3 in accordance with an example embodiment. The contoured indentation 136 may be formed in a guide surface 174 of the lift base 134. In some embodiments, the guide surface 174 may be a relatively flat or planar surface, however, in other embodiments, the guide surface 174 may be a non-planar surface. Similarly, in some embodiments, the contoured indentation 136 may be of relatively uniform depth, however, in other embodiments, the depth of the contoured indentation 136 may be non-uniform.

As further shown in FIG. 7, the contoured indentation 136 may have an outer perimeter 176. In some embodiments, the outer perimeter 176 of the contoured indentation 136 may be irregularly shaped, while in some other embodiments, the outer perimeter 176 may have a regular or readily-recognizable shape (e.g. polygonal, etc.). Although FIG. 7 shows only a single contoured indentation 136 corresponding to one of the lift bases 134, it will be appreciated that each pivot assembly 132 includes a pair of lift bases 134 having guide faces 174 that are spaced apart and opposingly facing such that the contoured indentations 136 are opposingly facing and spaced apart by an operatively sufficient distance to moveably capture and retain the guide pegs 156 that extend outwardly from the lift support 138. Accordingly, it may be appreciated that the contoured indentations 136 of each opposingly-facing pair of lift bases 134 may be mirror images (at least approximately) of each other.

In some embodiments, the contoured indentation 136 forms a contoured body 178 disposed within the contoured indentation 136. For example, in some embodiments, the contoured body 178 may be formed in the guide surface 174 of the lift base 134 such that the contoured body 178 forms an island-like structure within the contoured indentation 136, wherein the contoured body 178 does not contact or engage the outer perimeter 176 of the contoured indentation 136. In other embodiments, the contoured indentation 136 may be configured differently such that the contoured body 178 is not formed with the contoured 24 indentation 136, or may be configured such that the contoured body 178 is not an island-like structure, but rather, the contoured body 178 may contact or be engaged with the outer perimeter 176.

Accordingly, the contoured indentations 136 of the pivot bases 162 of the pivot assembly 132 may have a wide variety of suitable shapes and orientations consistent with the present disclosure, and should not be construed as being limited to the particular embodiments described herein or shown in the accompanying figures.

E. Operation of Preferred Embodiment

Embodiments of tilting pad assemblies in accordance with the present disclosure May advantageously enable a pad of an exercise machine (or other suitable device) to be easily movable between a lowered (or level) position and a raised (or tilted) position. Such embodiments in accordance with the present disclosure may advantageously enable a user to adjust a position of a pad of an exercise machine whenever they desire to do so in a quick and convenient manner.

In some embodiments, when the guide pegs 156 are positioned at the first position 164 (FIG. 5), the tilting pad assembly 120 is in the lowered position 124 with the pad 128 in a generally lowered (or level) position. When a user applies a lifting force 168 on the pad (e.g. by grasping a leading edge 170 of the pad 128 and lifting upwardly), the guide pegs 156 are moved upwardly within the contoured indentations 136 of the lift bases 134 to reposition the guide pegs 156 from the first position 164 (FIG. 5) to the second position 166 (FIG. 6), and the pad 128 pivots on the pivot bases 162 into the raised position 126. With the guide pegs 156 positioned at the second position 166, the tilting pad assembly 120 is held stably in the raised position 126 with the pad 128 in a generally tilted (or non-level) position.

More specifically, the operation of the pivot assembly 132 will now be described with reference to FIGS. 7-10. In the following discussion, for the sake of simplicity, the operation of the pivot assembly 132 will be described with reference to the movement of one of the guide pegs 156, however, it should be appreciated that all of the guide pegs 156 are simultaneously moving within the contoured indentations 136 of the pivot assembly 132 in the same or substantially similar manner.

Initially, the tilting pad assembly 120 may be positioned with the pad 128 in the lowered position 124, wherein the guide pegs 156 are positioned in the first position 164 within the contoured indentations 136 as shown in FIG. 7. With the guide peg 156 positioned in the first position 164, the tilting pad assembly 120 is held stably in the lowered position 124 with the pad 128 in a generally lowered (or level) position (see FIG. 5). As best shown in FIG. 7, in some embodiments, the first position 164 of the guide peg 164 may be located at a relatively low location within the contoured indentation 136, and May be situated below the contoured body 178 formed within the contoured indentation 136.

Figure 8:
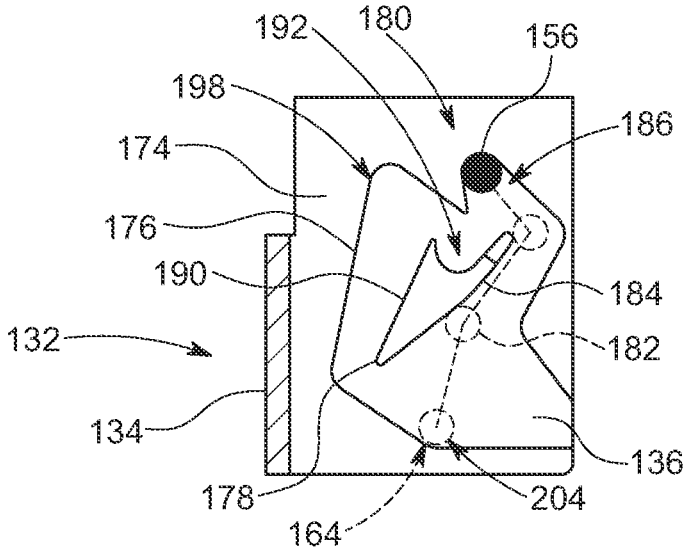
FIG. 8 is a side elevational view of the contoured indentation of the tilting pad assembly of FIG. 3 with the guide peg in a first intermediate position in accordance with an example embodiment.

When the user begins to raise the pad 128 from the lowered position 124 toward the raised position 126, the guide peg 156 begins to move away from the first position 164 (FIG. 7), and in some embodiments, the guide peg 156 may move into a first intermediate position 180 before arriving at the second position 166. FIG. 8 shows the contoured 13 indentation 136 of the pivot assembly 132 with the guide peg 156 moved into the first intermediate position 180 in accordance with an example embodiment.

More specifically, in some embodiments, as the guide peg 156 is moved from the first position 164 to the first intermediate position 180, the guide peg 156 may follow a first travel path 182 shown in dashed lines in FIG. 8. In some embodiments, as the guide peg 156 moves along the first travel path 182 it may contact and slide along a lower body surface 184 of the contoured body 178. The lower body surface 184 of the contoured body 178 May be configured to enable the guide peg 156 to slide along the lower body surface 184, and may guide and direct the guide peg 156 along a portion of the first travel path 182 toward the first intermediate position 180. In some embodiments, when the guide peg 156 reaches the first intermediate position 180, the guide peg 156 may engage with a first notch 186 formed by the outer perimeter 176 of the contoured indentation 136 that at least partially assists to halt the movement of the guide peg 156 in the first intermediate position 180 (FIG. 8).

Figure 9:
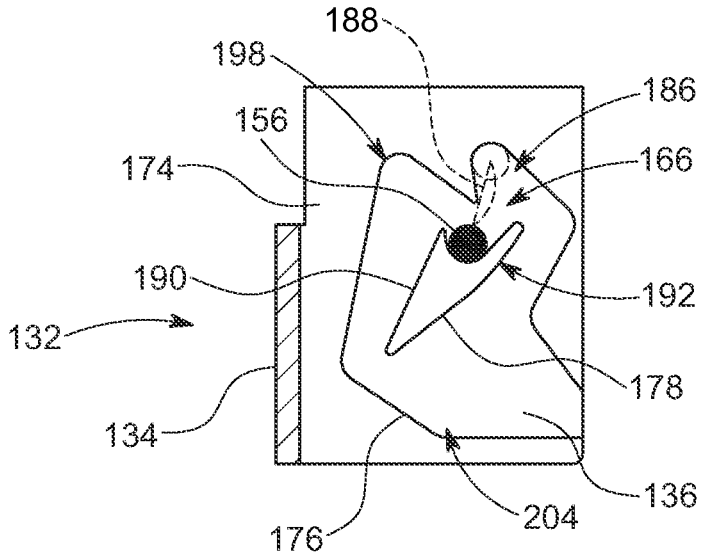
FIG. 9 is a side elevational view of a contoured indentation of the tilting pad assembly of FIG. 3 with the guide peg in a second position in accordance with an example embodiment.

Next, as shown in FIG. 9, in some embodiments, the guide peg 156 moves from the first intermediate position 180 along a second travel path 188 (shown in dashed lines) to the second position 166. In some embodiments, the contoured body 178 may include an upper body surface 190 having a second notch 192 formed therein that at least partially assists to halt the movement of the guide peg 156 in the second position 166 (FIG. 9). As noted above, with the guide peg 156 in the second position 166, the tilting pad assembly 120 is held stably in the raised position 126 with the pad 128 in a generally tilted (or non-level) position (see FIG. 6).

Figure 10:
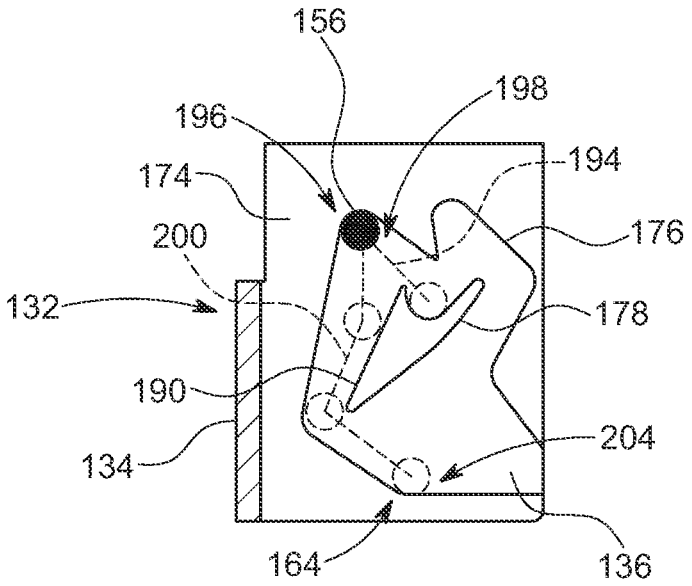
FIG. 10 is a side elevational view of the contoured indentation of the tilting pad assembly of FIG. 3 with the guide peg in a second intermediate position in accordance with an example embodiment.

As shown in FIG. 10, in some embodiments, when the user desires to return the tilting pad assembly 120 to the lowered position 124, the user may again apply the lifting force 168 on the leading edge 170 of the pad 128, causing the guide peg 156 to move from the second position 166 along a third travel path 194 (shown in dashed lines in FIG. 10) to a second intermediate position 196. In some embodiments, when the guide peg 156 reaches the second intermediate position 196, the guide peg 156 may engage with a third notch 198 formed by the outer perimeter 176 of the contoured indentation 136 that at least partially assists to halt the movement of the guide peg 156 in the second intermediate position 196 (FIG. 10).

With continued reference to FIG. 10, in some embodiments, after reaching the second intermediate position 196, the guide peg 156 may move downwardly along a fourth travel path 200 (shown in dashed lines). In some embodiments, as the guide peg 156 moves along the fourth travel path 200 it may contact and slide along the upper body surface 190 of the contoured body 178. The upper body surface 190 of the contoured body 178 may be configured to enable the guide peg 156 to slide along the upper body surface 190, and may guide and direct the guide peg 156 along a portion of the fourth travel path 200 toward the first position 164. In some embodiments, when the guide peg 156 reaches the first position 164, the guide peg 156 may engage with a fourth notch 204 formed by the outer perimeter 176 of the contoured indentation 136 that at least partially assists to halt the movement of the guide peg 156 in the first position 164 (FIG. 10).

Accordingly, in some embodiments, a tilting pad assembly 120 comprises a pad 128 configured to be pivotably coupled to a pad support 130, and a pair of lift bases 134. In some embodiments, each lift base 134 has a contoured indentation 136 disposed therein, and the pair of lift bases 134 are configured to be coupled to the pad support 130 such that the contoured indentations 136 are opposingly facing and spaced apart. In some embodiments, the tilting pad assembly 120 may further include a lift support 138 having a first end 140 pivotably coupled to the pad 128 and a second end 142 having a pair of guide pegs 156 extending outwardly from the second end 142 in opposing directions and into engagement with a corresponding one of the contoured indentations 136 such that the second end 142 of the lift support 138 is moveably captured between the pair of lift bases 134 with the pair of guide pegs 156 disposed within the opposingly-facing contoured indentations 136. In some embodiments, the contoured indentations 136 are configured to provide a first position 164 for the guide pegs 156 wherein the pad 128 is stably supported by the lift support 138 in a lowered position 124, and to provide a second position 166 for the guide pegs 156 wherein the pad 128 is stably supported by the lift support 138 in a raised position 126.

In further embodiments, each contoured indentation 136 may be configured to provide a contoured body 178 disposed therein, the contoured body 178 having an upper body surface 190, the guide pegs 156 being engaged with the upper body surface 190 when the guide pegs 156 are in the second position 166. In some embodiments, each contoured indentation 136 has an outer perimeter 176 having a notch (e.g. fourth notch 204) formed therein, the guide pegs 156 being engaged with the notch (e.g. fourth notch 204) formed in the outer perimeter 176 when the guide pegs 156 are in the first position 164.

In some embodiments, the pad 128 is pivotably coupled to the pad support 130 at a pivot base 162 such that the pad 128 is pivotable about the pivot base 162 as the guide pegs 156 are moved within the contoured indentations 136 between the first position 164 and the second position 166.

In addition, in some embodiments, each contoured indentation 136 has an outer perimeter 176 having a notch (e.g. fourth notch 204) formed therein, the guide pegs 156 being engaged with the notch (e.g. fourth notch 204) when the guide pegs 156 are in the first position 164. And in some embodiments, each contoured indentation 136 is configured to provide a contoured body 178 disposed therein, the contoured body 178 having an upper body surface 190, the guide pegs 156 being engaged with the upper body surface 190 when the guide pegs 156 are in the second position 166. Similarly, in some embodiments, the upper body surface 190 of the contoured body 178 has a notch (e.g. second notch 192) formed therein, the guide pegs 156 being engaged with the notch (e.g. second notch 192) formed in the upper body surface 190 when the guide pegs 156 are in the second position 166.

And in some embodiments, the contoured body 178 has a lower body surface 184, and wherein each contoured indentation 136 has an outer perimeter 176 having a notch (e.g. first notch 186) formed therein, the guide pegs 156 being slideably moveable along the lower body surface 184 and engageable with the notch (e.g. first notch 186) in a first intermediate position 180 as the guide pegs 156 are moved from the first position 164 to the second position 166. In still further embodiments, each contoured indentation 136 has an outer perimeter 176 having a notch (e.g. third notch 198) formed therein, the guide pegs 156 being engageable with the notch (e.g. third notch 198) in a second intermediate position 196 and being slideably moveable along the upper body surface 190 as the guide pegs 156 are moved from the second position 166 to the first position 164.

In still further embodiments, each lift base 134 includes a flat surface (e.g. guide surface 174), the contoured indentation 136 being disposed in the flat surface (e.g. guide surface 174), the contoured indentations 136 being spaced apart by an operational distance that enables the second end 142 of the lift support 138 to move between the flat surfaces (e.g. guide surfaces 174) as the pair of guide pegs 156 are moved between the first position 164 and the second position 166.

And in some embodiments, an exercise machine 100 comprises: a support frame 102; and a tilting pad assembly 120 operatively coupled to the support frame. In some embodiments, the tilting pad assembly 120 includes at least: a pad 128; and at least one pivot assembly 132 pivotably coupling the pad 128 to a pad support 130, the at least one pivot assembly 132 including: a pair of lift bases 134, each lift base 134 having a contoured indentation 136 disposed therein, the pair of lift bases 134 being coupled to the pad support 130 such that the contoured indentations 136 are opposingly facing and spaced apart; and a lift support 138 having a first end 140 pivotably coupled to the pad 128 and a second end 142 having a pair of guide pegs 156 extending outwardly from the second end 142 in opposing directions and into engagement with a corresponding one of the contoured indentations 136 such that the second end 142 of the lift support 138 is moveably captured between the pair of lift bases 134 with the pair of guide pegs 156 moveably disposed within the opposingly-facing contoured indentations 136, wherein the contoured indentations 136 provide a first position 164 for the guide pegs 156 wherein the pad 128 is stably supported by the lift support 138 in a lowered position 124, and further provides a second position 166 for the guide pegs 156 wherein the pad 128 is stably supported by the lift support 138 in a raised position 126.

In some embodiments, the at least one pivot assembly 132 comprises a pair of pivot assemblies 132. And in some embodiments, the exercise machine 100 further comprises a slidable carriage 108 slidably coupled to the support frame 102.

Embodiments of tilting pad assemblies in accordance with the present disclosure May provide considerable advantages over conventional pad assemblies. For example, embodiments of tilting pad assemblies may enable a user to easily adjust the position of the pad by simply applying a lifting force on a leading edge of the pad, moving the tilting pad assembly into a stably supported raised position, without the need for tools and without the need to actuating switches, release mechanisms, or other such devices. Similarly, the user may easily return the pad to the lowered position by applying another lifting force on the leading edge of the pad, returning the tilting pad assembly into a stably supported lowered position. Accordingly, embodiments in accordance with the present disclosure enable a user to adjust the position of the pad in a quick, easy, and convenient manner, thereby saving time and improving the user's satisfaction.

Any and all headings are for convenience only and have no limiting effect. Unless otherwise defined, all technical and scientific terms used herein have the same meaning as commonly understood by one of ordinary skill in the art to which this invention belongs. Although specific terms are employed herein, they are used in a generic and descriptive sense only and not for purposes of limitation. All patent applications, patents, and printed publications cited herein are incorporated herein by reference in their entireties, except for any definitions, subject matter disclaimers or disavowals, and except to the extent that the incorporated material is inconsistent with the express disclosure herein, in which case the language in this disclosure controls.

The present invention may be embodied in other specific forms without departing from the spirit or essential attributes thereof, and it is therefore desired that the present embodiment be considered in all respects as illustrative and not restrictive. Many modifications and other embodiments of the present disclosure will come to mind to one skilled in the art to which this invention pertains and having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although methods and materials similar to or equivalent to those described herein can be used in the practice or testing of the embodiments in the present disclosure, suitable methods and materials are described above. Thus, the present disclosure is not intended to be limited to the embodiments shown, but is to be accorded the widest scope consistent with the principles and features disclosed herein.

While various embodiments have been described above, it should be understood that they have been presented by way of example only, and not limitation. The descriptions are not intended to limit the scope of the technology to the particular forms set forth herein. To the contrary, the present descriptions are intended to cover such alternatives, modifications, and equivalents as may be included within the spirit and scope of the technology as defined by the appended claims and otherwise appreciated by one of ordinary skill in the art. The various embodiments of the present disclosure may be embodied in other specific forms without departing from the spirit or essential attributes thereof, and it is therefore desired that the various embodiments in the present disclosure be considered in all respects as illustrative and not restrictive. Thus, the breadth and scope of a preferred embodiment should not be limited by any of the above-described exemplary embodiments.

Unless otherwise defined, all technical and scientific terms used herein have the same meaning as commonly understood by one of ordinary skill in the art to which this invention belongs. All patent applications, patents, and printed publications cited herein are incorporated herein by reference in their entireties, except for any definitions, subject matter disclaimers or disavowals, and except to the extent that the incorporated material is inconsistent with the express disclosure herein, in which case the language in this disclosure controls. Any headings utilized within the description are for convenience only and have no legal or limiting effect.

What is claimed is:

1. A pivot assembly configured to pivotably couple a pad to a pad support, the pivot assembly comprising:

a pair of lift bases, each lift base having a contoured indentation disposed therein, the pair of lift bases being configured to be coupled to the pad support such that the contoured indentations are opposingly facing and spaced apart; and a lift support having a first end configured to be pivotably coupled to the pad and a second end having a pair of guide pegs extending outwardly from the second end in opposing directions and into engagement with the contoured indentations such that the second end of the lift support is moveably captured between the pair of lift bases with the pair of guide pegs moveably disposed within the contoured indentations, wherein the contoured indentations are configured to provide a first position for the guide pegs wherein the pad is stably supported by the lift support in a lowered position and further configured to provide a second position for the guide pegs wherein the pad is stably supported by the lift support in a raised position;

wherein the first end of the lift support is pivotably coupled to the pad by a coupling assembly, the coupling assembly including a tab member coupled to a lower pad surface, and a bale member coupled to the tab member and pivotably coupled to the first end of the lift support; and wherein the bale member is slideably moveable along a lengthwise portion of the tab member.

2. The pivot assembly of claim 1, wherein each lift base includes a flat surface, the contoured indentations being disposed in the flat surfaces.

3. The pivot assembly of claim 2, wherein the contoured indentations are opposingly facing and spaced apart by an operational distance that enables the second end of the lift support to move between the flat surfaces as the pair of guide pegs are moved between the first position and the second position.

4. The pivot assembly of claim 1, wherein each lift base includes a support portion that is configured to engage with the lower pad surface when the guide pegs are positioned in the first position.

5. The pivot assembly of claim 1, wherein the pad is pivotably coupled to the pad support at a pivot base such that the pad is pivotable about the pivot base as the guide pegs are moved within the contoured indentations between the first position and the second position.

6. The pivot assembly of claim 1, wherein each contoured indentation is configured to provide a contoured body disposed therein, the contoured body having an upper body surface, the guide pegs being engaged with the upper body surfaces when the guide pegs are in the second position.

7. The pivot assembly of claim 1, wherein each contoured indentation has an outer perimeter having a notch formed therein, the guide pegs being engaged with the notches formed in the outer perimeters when the guide pegs are in the first position.

8. An exercise machine, comprising:

a support frame; and a tilting pad assembly operatively coupled to the support frame, the tilting pad assembly including at least:

a pad; and at least one pivot assembly pivotably coupling the pad to a pad support, the at least one pivot assembly including:

a pair of lift bases, each lift base having a contoured indentation disposed therein, the pair of lift bases being coupled to the pad support such that the contoured indentations are opposingly facing and spaced apart; and a lift support having a first end pivotably coupled to the pad and a second end having a pair of guide pegs extending outwardly from the second end in opposing directions and into engagement with the contoured indentations such that the second end of the lift support is moveably captured between the pair of lift bases with the guide pegs moveably disposed within the contoured indentations, wherein the contoured indentations provide a first position for the guide pegs wherein the pad is stably supported by the lift support in a lowered position and provide a second position for the guide pegs wherein the pad is stably supported by the lift support in a raised position;

wherein the at least one pivot assembly comprises a pair of pivot assemblies.

9. The exercise machine of claim 8, further comprising a slidable carriage slidably coupled to the support frame.

* * * * *